US008701843B2

(12) United States Patent
Kao

(10) Patent No.: US 8,701,843 B2
(45) Date of Patent: Apr. 22, 2014

(54) FLYWHEEL ASSEMBLY FOR EXERCISE DEVICES

(75) Inventor: Kuang-Shiung Kao, Taichung (TW)

(73) Assignee: Michael Lin, Taipei (TW)

( * ) Notice: Subject to any disclaimer, the term of this patent is extended or adjusted under 35 U.S.C. 154(b) by 431 days.

(21) Appl. No.: 13/087,357

(22) Filed: Apr. 14, 2011

(65) Prior Publication Data

US 2012/0261222 A1 Oct. 18, 2012

(51) Int. Cl.
*B60L 7/00* (2006.01)

(52) U.S. Cl.
USPC ..... 188/164; 188/161; 188/267; 482/903

(58) Field of Classification Search
USPC ..... 188/164, 158, 159, 160, 161, 162, 163, 188/267; 310/93, 103, 105; 482/5, 6, 57, 482/63, 903
See application file for complete search history.

(56) References Cited

U.S. PATENT DOCUMENTS

| | | | | | |
|---|---|---|---|---|---|
| 5,072,930 | A * | 12/1991 | Sun | 482/5 |
| 5,711,404 | A * | 1/1998 | Lee | 188/164 |
| 5,848,953 | A * | 12/1998 | Wei et al. | 482/63 |
| 6,468,186 | B2 * | 10/2002 | Lay | 482/63 |
| 7,018,324 | B1 * | 3/2006 | Lin | 482/63 |
| 7,732,961 | B2 * | 6/2010 | Lin | 310/153 |
| 7,772,730 | B2 * | 8/2010 | Lin | 310/74 |

* cited by examiner

*Primary Examiner* — Pamela Rodriguez
(74) *Attorney, Agent, or Firm* — Huffman Law Group, P.C.

(57) ABSTRACT

A flywheel assembly for exercise devices includes a flywheel. A first disc and a second disc sequentially received in the flywheel and securely attached to each other. A control plate is rotatably sandwiched between the first disc and the second disc. Multiple magnetic devices are respectively and radially connected to the control plate. A shaft centrally extends through the first disc, the second disc and the flywheel, and laterally mounted onto the second disc, wherein the flywheel is rotatable relative to the first disc, the control plate with the magnetic devices and the second disc. A drive device is laterally mounted onto the second disc for driving the control plate and adjusting the damping to the flywheel when the control plate is rotated relative to the first disc and the second disc due to the operation from the drive device.

5 Claims, 4 Drawing Sheets

FLYWHEEL ASSEMBLY FOR EXERCISE DEVICES

BACKGROUND OF THE INVENTION

1. Field of the Invention

The present invention relates to a flywheel assembly for exercise devices, and more particularly to a flywheel assembly that provides damping to an exercise device and the damping can be smoothly and effectively adjusted due to magnets.

2. Description of Related Art

Nowadays more and more people lack exercise due to busy lifestyle. Indoor exercise devices, such as biking-simulation device, are therefore marketed for those busy people enjoying outdoor activities. Such exercise devices usually employ a flywheel assembly to provide a damping for increasing the load.

A conventional flywheel assembly comprises a flywheel rotatably mounted on the exercise device and a stator stably and co-axially received in the flywheel, wherein the stator can be co-axially reciprocally relative to the flywheel. The stator has multiple magnets peripherally mounted thereon for providing damping to the flywheel due to magnetic force. Consequently, the damping has a maximum value when the stator is fully received in the flywheel and the damping is gradually reduced when the stator is gradually moved away from the flywheel along an axis of the flywheel assembly.

The conventional flywheel assembly is hard to adjust/reduce the damping when the damping is in a maximum value because the operator needs to overcome the magnetic force before drawing the stator. In addition, the stator is moved along the axis of the flywheel such that the exercise device needs to provide an enlarged space for receiving the conventional flywheel. As a result, the volume of the exercise device with the conventional flywheel assembly is enlarged, accordingly.

Furthermore, with reference to Taiwan Pat. No. 356021 and No. M360708, the conventional flywheel assemblies usually provide two curved plates for mounting magnets that provide damping to the flywheel. The two curved plates correspond to each other and the two curved plates respectively concentrically correspond to the flywheel when providing a maximum damping. Each curved plate has a pivot end and a free end. When adjusting damping, each curved plate is wiggled relative to the pivot end such that the move route of the free end is a hypocycloid. Consequently, the damping can not equally act on the flywheel when the damping, acted on the flywheel, is less than the maximum.

The present invention has arisen to mitigate and/or obviate the disadvantages of the conventional flywheel assemblies.

SUMMARY OF THE INVENTION

The main objective of the present invention is to provide an improved flywheel assembly that provides damping to an exercise device and the damping can be smoothly and effectively adjusted due to magnets.

To achieve the objective, the flywheel assembly in accordance with the present invention comprises a flywheel made of magnetic induction material and including a cavity laterally and centrally defined therein. A first disc is received in the cavity and including multiple first grooves radially defined therein and equally dividing the first disc into several areas. A second disc is received in the cavity and securely attached to the first disc. The second disc includes multiple second grooves radially defined therein and each second groove aligns with a corresponding of first grooves in the first disc. A control plate is rotatably sandwiched between the first disc and the second disc. The control plate includes a series of curved grooves defined therein, and each curved groove has a first end and a second end respectively corresponding to a center and a periphery of the control plate. Multiple magnetic devices are respectively and radially connected to the control plate. Each magnetic device includes a seat, an axle and a permanent magnet that is secured on the seat and corresponds to a periphery of the cavity for providing damping to the flywheel. The axle extends through the seat and a corresponding one of the curved grooves for mounting the seat to the control plate. At least one protrusion is respectively formed on two opposite sides of the seat and each protrusion is reciprocally moved along a corresponding one of the first groove/second groove. A shaft centrally sequentially extends through the second disc, the first disc and the flywheel. The shaft is laterally mounted onto the second disc such that the flywheel is rotatable relative to the first disc, the second disc and the magnetic devices. Consequently, the damping from the magnetic devices to the flywheel is adjusted when the control plate is rotated relative to the first disc and the second disc.

Further benefits and advantages of the present invention will become apparent after a careful reading of the detailed description with appropriate reference to the accompanying drawings.

DETAILED DESCRIPTION OF THE INVENTION

Figure 1:
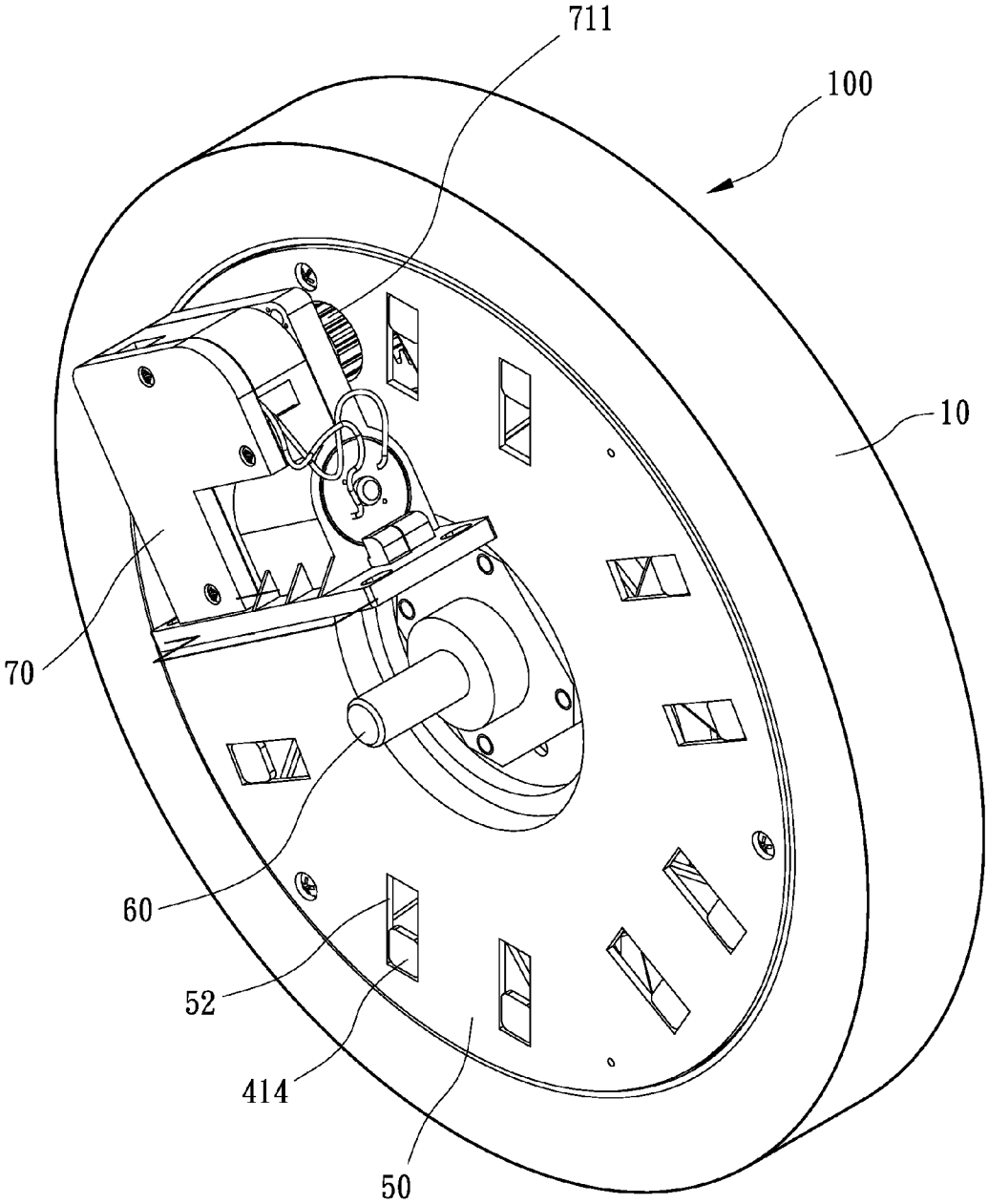
FIG. 1 is a perspective view of a flywheel assembly for exercise devices in accordance with the present invention.
Figure 2:
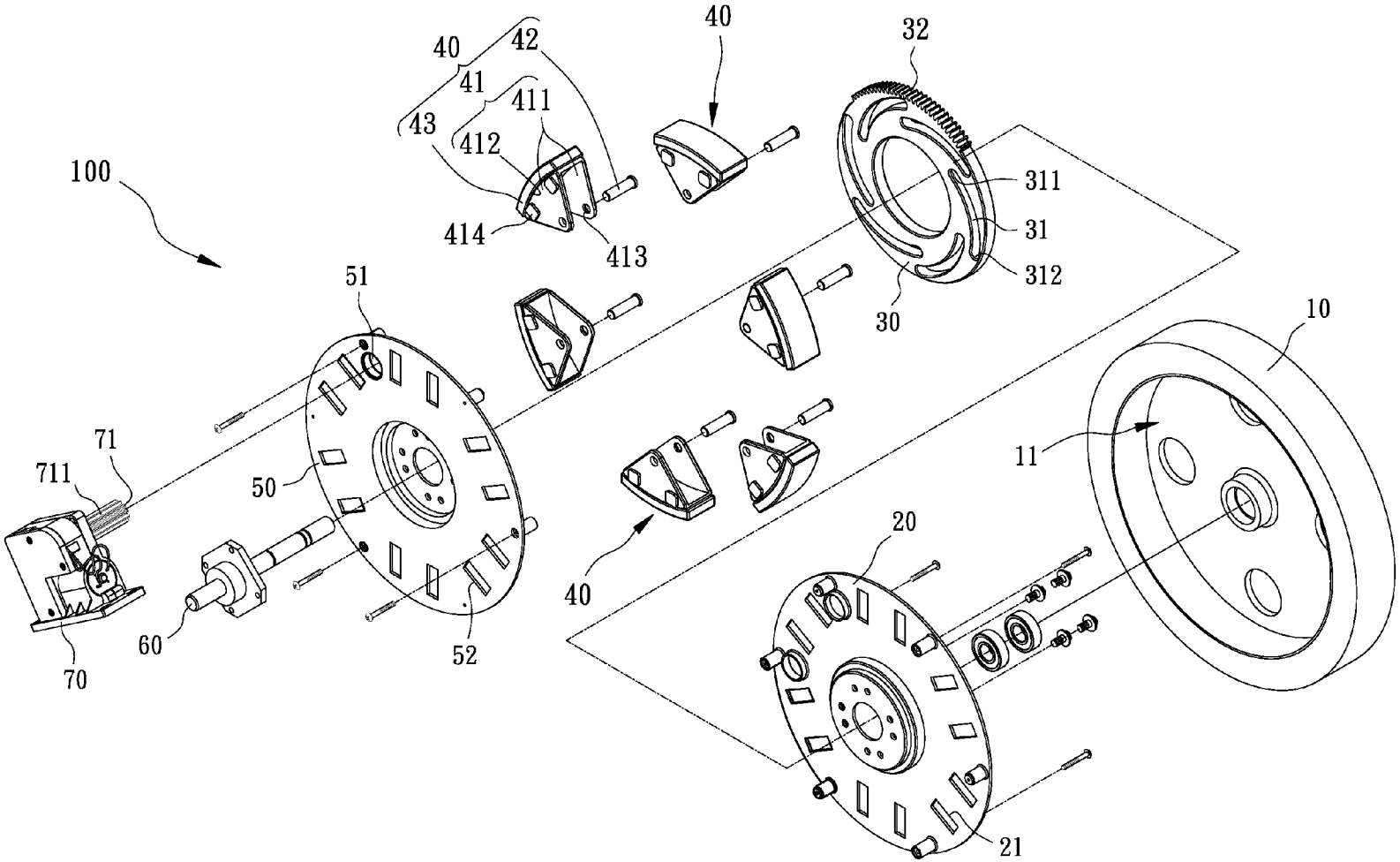
FIG. 2 is an exploded perspective view of the flywheel in FIG. 1.

Referring to the drawings and initially to FIGS. 1-4, a flywheel assembly (100) for exercise devices in accordance with the present invention comprises a flywheel (10). A first disc (20) and a second disc (50) sequentially received in the flywheel (10) and securely attached to each other. A control plate (30) is rotatably sandwiched between the first disc (20) and the second disc (50). Multiple magnetic devices (40) are respectively and radially connected to the control plate (30). A shaft (60) centrally extends through the first disc (20), the second disc (50) and the flywheel (10), and laterally mounted onto the second disc (50), wherein the two opposite ends of the shaft (60) are respectively secured on the exercise device (not shown) such that the flywheel (10) is rotatable relative to the first disc (10), the control plate (30) with the magnetic devices (40) and the second disc (50). A drive device (70) is laterally mounted onto the second disc (50) for driving the control plate (30) and the radial distance between each magnetic device (40) and the interior of the flywheel (10) is adjusted for adjusting the damping to the flywheel (10) when the control plate (30) is rotated relative to the first disc (20) and the second disc (50) due to the operation from the drive device (70).

The flywheel (10) is made of magnetic induction material. In the preferred embodiment of the present invention, the flywheel (10) is made of cast iron. A cavity (11) is laterally and centrally defined in the flywheel (10) for receiving the first disc (20), the control plate (30), magnetic devices (40) and the second disc (50).

The first disc (20) is received in the cavity (11). The first disc (20) includes multiple first grooves (21) radially defined therein and equally dividing the first disc (20) into several areas, wherein the quantity of the first groove (21) corresponds to that of the magnetic device (40).

The control plate (30) has a series of curved grooves (31) defined therein. Each curved groove (31) has a first end (311) and a second end (312) respectively corresponding to a center and a periphery of the control plate (30), wherein the quantity of the curved groove (31) is equal to that of the magnetic device (40). A teethed portion (32) is peripherally formed on the control plate (30) and corresponds to the drive device (70).

The second disc (50) has a through hole (51) defined therein and multiple second grooves (52) radially defined therein, wherein each second groove (52) aligns with a corresponding one of the first groove (21) in the first disc (20).

Each magnetic device (40) includes a seat (41), an axle (42) and a permanent magnetic (43). The seat (41) includes a curved plate (412) and two side plates (411) respectively extending from two opposite sides of the curved plate (412). The two side plates (411) respectively correspond to two opposite sides of the control plate (30). Each side plate (411) has a hole (413) defined therein and at least one protrusion (414) laterally and outwardly extending therefrom, wherein each protrusion (414) is slidably received in the corresponding one of the first groove (21)/second groove (52). The axle (42) extends through a corresponding one of the curved grooves (31) and has two opposites ends securely received in the holes (413) in the two side plates (411). Consequently, each magnetic device (40) is radially and reciprocally moved relative to the first disc (20) and the second disc (50), and each protrusion (414) reciprocally moved along the corresponding first groove (21)/second groove (52) when the control plate (30) is rotated by the drive device (70). The permanent magnetic (43) is secured on curved plate (412) of each of the magnetic devices (40) for providing a damping to the flywheel (10) and the damping is adjusted when the magnetic device (40) is radially moved relative to the first disc (20) and the second disc (50).

In the preferred embodiment of the present invention, the drive device (70) is motor and has a drive shaft (71) extending through the through hole (51) is the second disc (50). A series of teeth (711) is peripherally and longitudinally formed on the drive shaft (71) and engaged to the teethed portion (32) of the control plate (30) for rotatably driving the control plate (30) to adjusting the damping acted on the flywheel (10).

Figure 3:
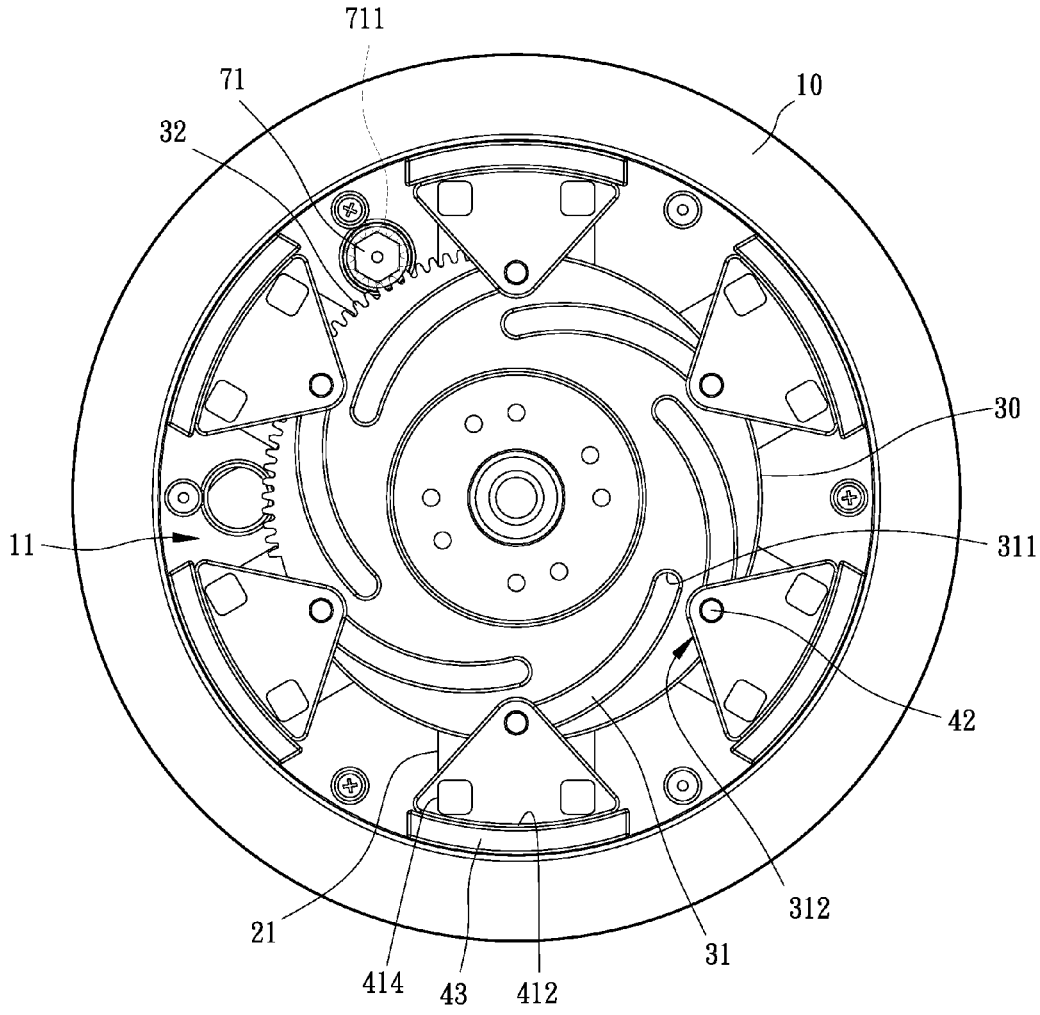
FIG. 3 is a first operational view of the magnetic devices in accordance with the present invention when providing a maximum damping to the flywheel.
Figure 4:
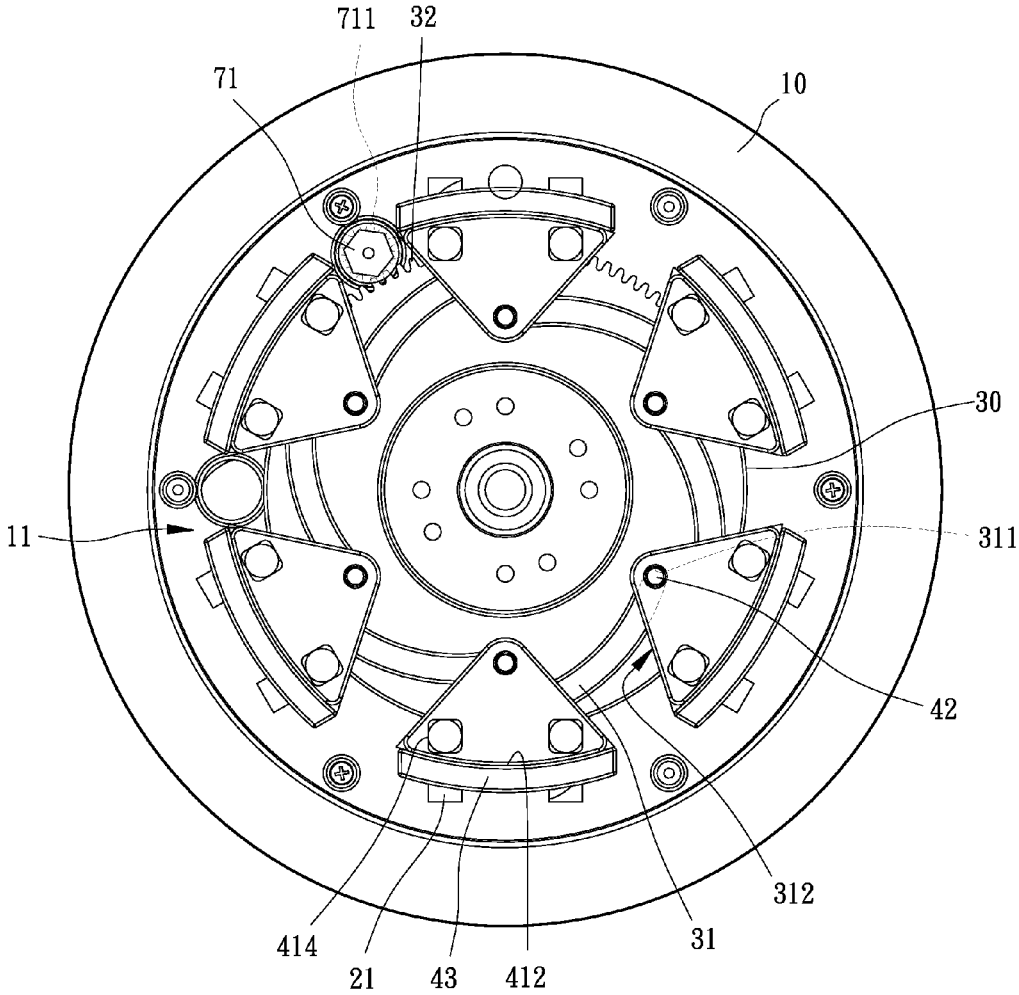
FIG. 4 is a second operational view of the magnetic devices in accordance with the present invention when providing a minimum damping to the flywheel.

With reference to FIG. 3, the magnetic devices (40) provide a maximum damping to the flywheel (10) when the axle (42) engaging to the second end (312) of the corresponding curved groove (31) and the distance between the permanent magnets (43) and the periphery of the cavity (11) in the flywheel (10) is minimum. The control plate (30) is rotated, anti-clockwise, due to the operated drive shaft (71) such that each axle (42) moved along the corresponding curved groove (31) toward the first end (311), the magnetic devices (40) radially and inwardly moved relative to the flywheel (10) and the each protrusion (414) moved along the corresponding first groove (21)/second groove (52). As a result, the damping from the magnetic devices (40) to the flywheel (10) is gradually reduced. The magnetic devices (40) provide a minimum damping to the flywheel (10) when the axle (42) engaging to the first end (311) of the corresponding curved groove (31) and the distance between the permanent magnets (43) and the periphery of the cavity (11) in the flywheel (10) is maximum.

Although the invention has been explained in relation to its preferred embodiment, it is to be understood that many other possible modifications and variations can be made without departing from the spirit and scope of the invention as hereinafter claimed.

What is claimed is:

1. A flywheel assembly for exercise devices, comprising:

a flywheel made of magnetic induction material and including a cavity laterally and centrally defined therein;

a first disc received in the cavity and including multiple first grooves radially defined therein and equally dividing the first disc into several areas;

a second disc received in the cavity and securely attached to the first disc, the second disc including multiple second grooves radially defined therein, each second groove aligning with a corresponding one of first grooves in the first disc;

a control plate rotatably sandwiched between the first disc and the second disc, the control plate including a series of curved grooves defined therein, each curved groove having a first end and a second end respectively corresponding to a center and a periphery of the control plate;

multiple magnetic devices respectively and radially connected to the control plate, each magnetic device including a seat, an axle and a permanent magnet that is secured on the seat and corresponds to a periphery of the cavity for providing damping to the flywheel, the axle extending through the seat and a corresponding one of the curved grooves for mounting the seat to the control plate, at least one protrusion respectively formed on two opposite sides of the seat, each protrusion reciprocally moved along a corresponding one of the first grooves/second grooves; and a shaft centrally sequentially extending through the second disc, the first disc and the flywheel, the shaft laterally mounted onto the second disc such that the flywheel is rotatable relative to the first disc, the second disc and the magnetic devices;

whereby the damping from the magnetic devices to the flywheel is adjusted when the control plate is rotated relative to the first disc and the second disc.

2. The flywheel assembly as claimed in claim 1, wherein the seat includes a curved plate and two side plates respectively extending from two opposite sides of the curved plate, the at least one protrusion laterally and outwardly extending from each side plate, the permanent magnet secured on the curved plate, the axle having two opposite ends respectively secured in a corresponding one of the two side plates.

3. The flywheel assembly as claimed in claim 1 further comprising a drive device laterally mounted onto the second disc for driving the control plate.

4. The flywheel assembly as claimed in claim 3, wherein the drive device is a motor.

5. The flywheel assembly as claimed in claim 3, wherein the control plate includes a teethed portion peripherally formed thereon and the drive device includes a drive shaft extending through the second plate, a series of teeth is peripherally and longitudinally formed on the drive shaft and engaged to the teethed portion of the control plate for rotatably driving the control plate to adjusting the damping acted on the flywheel.

* * * * *